US008196638B2

(12) United States Patent
Roberts et al.

(10) Patent No.: US 8,196,638 B2
(45) Date of Patent: Jun. 12, 2012

(54) PLEATED SCREEN APPARATUS

(76) Inventors: Anthony Gerard Roberts, Burleigh Heads (AU); Kevin Burnside, Burleigh Heads (AU); Chris Bonython, Burleigh Heads (AU)

( * ) Notice: Subject to any disclaimer, the term of this patent is extended or adjusted under 35 U.S.C. 154(b) by 158 days.

(21) Appl. No.: 12/753,177

(22) Filed: Apr. 2, 2010

(65) Prior Publication Data

US 2010/0252210 A1 Oct. 7, 2010

(30) Foreign Application Priority Data

Apr. 2, 2009 (AU) ..... 2009901418

(51) Int. Cl.
*E06B 3/94* (2006.01)

(52) U.S. Cl. ..... 160/84.06; 160/194

(58) Field of Classification Search ..... 160/84.06, 160/31, 194, 201, 240, 268.1, 271, 272, 277, 160/279, 84.04, 84.05
See application file for complete search history.

(56) References Cited

U.S. PATENT DOCUMENTS

| | | | | |
|---|---|---|---|---|
| 5,099,906 | A | 3/1992 | Chigusa et al. | |
| 5,176,194 | A | 1/1993 | Chigusa | |
| 5,351,737 | A | 10/1994 | Hoshiyama | |
| 5,873,401 | A | 2/1999 | Tsuchida | |
| 6,186,212 | B1 | 2/2001 | Tsuchida | |
| 6,978,820 | B2 * | 12/2005 | Aoki | 160/84.06 |
| 7,472,738 | B2 * | 1/2009 | Kamosawa et al. | 160/84.06 |
| 7,669,632 | B2 * | 3/2010 | Moriya et al. | 160/31 |
| 7,694,711 | B2 | 4/2010 | Okachi et al. | |
| 7,810,543 | B2 * | 10/2010 | Donatelli et al. | 160/31 |
| 7,931,070 | B2 * | 4/2011 | Chino et al. | 160/194 |
| 7,984,744 | B2 * | 7/2011 | Karasawa et al. | 160/84.06 |
| 2010/0252210 | A1 * | 10/2010 | Roberts et al. | 160/84.04 |

FOREIGN PATENT DOCUMENTS

| | | |
|---|---|---|
| AU | 59985/90 | 2/1991 |
| AU | 59982/90 | 3/1991 |
| AU | 30012/92 | 1/1993 |
| AU | 199660521 | 1/1997 |
| AU | 2005252562 | 12/2005 |
| AU | 2007261986 | 12/2007 |
| AU | 2007318514 | 5/2008 |
| AU | 2009201950 | 2/2010 |

* cited by examiner

*Primary Examiner* — Blair M. Johnson
(74) *Attorney, Agent, or Firm* — Berenato & White, LLC

(57) ABSTRACT

The present invention relates generally to barriers for architectural openings, in particular to a screen apparatus and method for screening off an architectural opening. The screen apparatus includes an elongated overhead frame member, a transverse fixed side frame member, a displaceable side frame member, and an elongated articulated bottom frame member. A screen member extends between the frame members, the screen member being interchangeable between a collapsed condition when the screen is open and an extended condition when the screen is closed by movement of the displaceable side frame member.

16 Claims, 14 Drawing Sheets

PLEATED SCREEN APPARATUS

CROSS-REFERENCE TO RELATED APPLICATIONS AND CLAIM TO PRIORITY

This application is related to Australian provisional patent application number 2009901418, filed Apr. 2, 2009, the disclosure of which is incorporated by reference and to which priority is claimed.

FIELD OF THE INVENTION

This invention relates to barriers for architectural openings.

This invention relates particularly to a pleated screen apparatus for extending across an architectural opening, such as a door or window opening, so as to provide a screen across such an opening and it will therefore be convenient to hereinafter describe the invention with reference to this example application. It is to be clearly understood however that the invention is capable of broader application. For example it may apply to screens other than pleated screens.

BACKGROUND TO THE INVENTION

Several types of screens for resisting the passage of flying insects through an architectural opening such as a door or a window opening into a dwelling are known.

One type of screen is a pleated screen apparatus. A pleated screen apparatus has a screen member that is folded in a way to form a plurality of pleats. The screen member can be interchanged between a folded condition in which the screen per se is open and a spread condition extending across and closing off the architectural opening in which the screen is closed.

The pleated screen apparatus may comprise an overhead frame member or head rail and a bottom frame member extending parallel to the overhead member spaced below the overhead member.

The apparatus also includes a stationary fixed side frame member extending between associated ends of the overhead and bottom frame member. The apparatus also includes a displaceable side frame member or handle that also extends between the overhead and bottom frame members. The displaceable side frame member is displaced towards and away from the stationary side member to respectively fold the pleated screen member to open the opening, or spread the pleat member to screen off the opening collectively defined by the members.

A feature of a pleated screen apparatus is that the bottom frame member is an articulated member comprising a plurality of links that are pivotally attached to each other, not unlike a belt chain. The articulating links extend along a bottom edge of the screen member when the screen is closed.

When the displaceable side frame member is displaced towards the stationary side frame member to fold the pleated screen member, the articulated bottom frame member is passed into the fixed side frame member where it is received and wherein the member extends parallel to the fixed side member. In order for the bottom frame member to be received within the stationary side member it has to turn through ninety degrees and then travel in an upward direction parallel to the stationary support of the screen apparatus.

Some challenges involved with pleated screen apparatuses include tautly supporting the pleat screen member in position. In particular it is useful to tautly hold the pleat screen member extending across the opening when it is in the spread condition. It is also useful to be able to evenly displace the pleat screen between the spread and folded positions to maintain the aesthetic appearance of the screen and also to maintain efficacy of the screen.

Pleat screen apparatuses have found application in openings of limited longitudinal length. With prior constructions of pleated screen apparatuses of which the applicant is aware, the span width which can be covered by the screen member is limited to the height of the screen opening. This is because the articulated bottom frame member is vertically received within the fixed side frame member. That is the bottom frame member must be capable of being longitudinally received within the fixed side frame member when it is in a linearly extended configuration. Therefore the length of the bottom frame member cannot be longer than the height of the stationary side member. Consequently pleated screen apparatuses have found application in windows where the window width and window height are comparable.

It would be useful if pleated screen apparatuses could be devised in which the width of the opening, i.e. the length of the bottom frame member was not limited to the height of the side frame member. This would open up a myriad of new potential applications for a pleated screen apparatus. For example pleated screen apparatuses could be used to cater for wide architectural openings such as wide door openings. Wide door openings are becoming particularly popular in modern architectural designs, particularly with the increased use of bi-fold doors. It is not unusual to have an opening of 3-6 m opening from the interior of a dwelling onto an outdoor living area.

Clearly therefore it would be advantageous if a pleated screen apparatus could be devised in which the width of the opening covered by the screen member was not effectively limited by the height of the opening and the width could be significantly wider than the height of the opening.

SUMMARY OF THE INVENTION

Accordingly the invention provides a screen apparatus, which includes:

- an elongated overhead frame member having one end and an opposite end, the overhead frame member defining lengthwise an overhead travel path;
- a transverse fixed side frame member having a lower end and an upper end that is fixedly mounted to the overhead frame member towards said one end, the fixed side frame member defining a side travel path extending longitudinally up the side frame member, that is continuous with the overhead travel path and that has a travel path entrance towards the bottom end thereof;
- a displaceable side frame member substantially parallel to the fixed side frame member that is displaceable towards the fixed side frame member to open the screen and is displaceable away from the fixed side frame member to close the screen;
- an elongated articulated bottom frame member having one end that is attached towards a bottom end of the displaceable side frame member so that the articulated bottom frame member is displaced when the screen is moved from the closed to the open position, the articulated side frame member having a length that is greater than that of the side travel path so that it enters the side travel path through the travel path entrance, and travels up through the side travel path and then through at least part of the overhead travel path when the displaceable side frame member is displaced towards the fixed side frame member to open the screen apparatus; and a screen member extending between the frame members, the screen member being interchangeable between a collapsed condition when the screen is open and an extended condition when the screen is closed by movement of the displaceable side frame member.

The elongated overhead frame member may be fixed and may extend across the full width of the architectural opening.

The screen member may be formed from a mesh, and may be generally oblong when extended. This is, the longitudinal length of the screen member may be greater than its transverse width. The screen member may include a plurality of longitudinally spaced apart transverse fold lines, so that the screen folds along the fold lines when the displaceable side frame member is displaced towards the fixed side frame member, so that the screen is collapsible concertina-fashion.

The apparatus may be a pleated screen apparatus and the screen member may be folded when the screen is open and spread when the screen is closed.

The elongated articulated bottom frame member may include a plurality of link members arranged in series and adjacent link members may be pivotal relative to each other. The link members may be pivotally mounted to each other, e.g. by pivot pins about transverse pivot axes and the link members may be contiguous with each other.

The articulated bottom frame member may define a longitudinally extending open channel for receiving a lower end portion of the screen therein.

The screen member may include a lower portion and the lower portion thereof may be received in the open channel in use when the screen member is in the spread condition, e.g. when the displaceable side frame member is displaced away from the fixed side frame member.

The screen apparatus may include a guide formation provided on a support surface above which the screen apparatus is installed. The guide formation may be a guide track, e.g. a horizontal track rail, and the guide track may guide displacement of the articulated bottom frame member across the support surface when the screen is moved between open and closed positions.

The articulated bottom frame member may define transversely spaced apart downwardly projecting guide or retainer formations for cooperating with the guide track on the support surface.

Each link member may include spaced apart opposing link sidewalls and a link web extending transversely between the sidewalls intermediate upper and lower edges of the sidewalls. The open channel of the bottom frame member may be defined between upper portions of the link sidewalls and the link web. The retainer or guide formations may be formed by lower parts of the link sidewalls.

The displaceable side frame member may also include retainer formations, e.g. towards a bottom end thereof for cooperating with the guide track provided on the support surface. This enables the guide track to guide displacement of the displaceable side frame member across the support surface.

The articulated bottom frame member may include a plurality of longitudinally spaced apart transversely projecting guide formations. Each link member may include two guide formations, one on each link sidewall, that project transversely outwards away from the associated link sidewall.

Each of the fixed side frame member and the overhead frame member may define guide paths within which the transversely projecting guide formations are received, and with which the transverse projecting guide formations cooperate to guide displacement of the articulated bottom frame member along the side travel path and the overhead travel path.

Each link member may include two guide formations, one on each link sidewall, that project transversely outwards away from the associated link sidewall. Each of the fixed side frame members and the overhead frame member may define guide slots or guide channels for cooperating with the guide formations on the link members.

The fixed side frame member may include a top portion where it joins with the overhead frame member. The fixed side frame member my also include a bottom portion where it joins with the guide rail guiding movement of the bottom frame member and moveable side frame member across the support surface.

The bottom portion of the fixed side frame member may include a lower turn guide formation for causing the link members to turn through 90 degrees to enable them to travel vertically up through the side travel path fixed side frame member.

The lower turn guide formation may comprise opposing sidewalls that define opposing curved guide slots, each of which curves through an angle of 90 degrees (or undergoes a change in direction of 90 degrees) for guiding displacement of the link members through 90 degrees when displaced around the 90 degree corner formed between the horizontal track rail and the vertically extending side travel path.

Similarly, the upper portion of the fixed side frame member may include an upper turn guide formation for causing the link members to turn through 90 degrees to enable them to transition from the vertically extending side travel path to the horizontally extending overhead travel path so that at least some of the link members can pass into the overhead travel path and be received within the overhead frame member.

The upper turn guide formation may include opposed curved guide slots that curve through an angle of 90 degrees for guiding displacement of the link members though 90 degrees from the vertically extending side travel path and the horizontally extending overhead travel path.

The overhead frame member may define another longitudinally extending overhead hanger travel path, e.g. that faces downwardly, that is below the overhead travel path for the link members. The overhead frame member may include longitudinally extending opposing hanger rails that project inwardly towards each other from side walls of the overhead frame member whereby to form and define said overhead hanger path.

The screen apparatus may further include a plurality of hanger members that are mounted on the overhead frame member within the overhead hanger path and which can travel along the overhead hanger path by sliding displacement along the hanger travel path.

Each hanger member may include an attachment formation for attaching to the screen and/or an uppermost tension chord of the tension chord arrangement for supporting the screen. The attachment formation may include a snaring formation having a free end for snaring the screen or tension chord. The snaring formation may be a hook like formation, e.g. a hook.

The bottom frame member may include a bottom attachment formation path. The bottom attachment formation path may include bottom side channels on either side of the bottom frame member. The path may be defined in the sides of the links making up the bottom channel frame member.

The screen apparatus may also include a plurality of bottom attachment formations that are mounted on the articulated bottom frame member and can slide along the bottom attachment formation path. The attachment formations may be received within the channels on either side of the links making up the bottom frame member.

In particular each bottom attachment formation may be mounted on both of the sidewalls of a link making up the bottom frame member and may be capable of sliding within the bottom side channels.

Each attachment formation may be adapted for attachment to a lowermost tension cord of the tension cord arrangement and/or the screen member, for resisting blow-out or push-out of the screen member from the upper channel of the articulated bottom frame member. Each screen attachment formation may include a snaring formation having a free end for snaring the screen or tension chord. The snaring formation may be a hook like formation, e.g. a hook.

The screen apparatus including the screen member may be manually displaced between spread and folded conditions by manual movement of the moveable side member towards and away from the fixed side member.

Further, the screen apparatus may include a pull chord arrangement for drawing or pulling the articulated bottom frame member into and along the side travel path and the overhead travel path when the displaceable side frame member is displaced towards the fixed side frame member, and also for pulling the bottom frame member out of the overhead and bottom frame members when the displaceable side frame member is moved away from the fixed side frame member.

The pull chord arrangement may include two chords, each chord extending between an end of the articulated bottom frame member and an upper end of the displaceable side frame member. The pull cords may be routed and arranged so that one pull chord pulls the articulated bottom frame member towards the side travel path and overhead travel path when the side frame member is displaced towards the fixed side frame member, and the other pull chord displaces the articulated bottom frame member away from the side travel path and overhead travel path when the displaceable side frame member is displaced away from the fixed side frame member.

The screen apparatus may also include a tension chord or cord arrangement for supporting the screen. The tension chord arrangement may include a plurality of chords that are attached towards the opposing end of the overhead frame member and are routed horizontally towards an upper end of the displaceable side frame member, vertically downwards into the displaceable side frame member, and horizontally out off the displaceable side frame member towards the fixed side frame member to which their other ends are attached.

The tension cords may be slidably laced through the mesh screen. The tension chords may extend downwards into the displaceable side frame member and may exit the displaceable side frame member at longitudinally spaced intervals more-or-less parallel to each other so that the screen is supported at said spaced intervals.

According to another aspect of the invention, there is provided a screen apparatus for an architectural opening, the screen apparatus including:

a vertical side frame member having a length, and a horizontal overhead frame member, the members jointly defining an elongated travel path extending along the fixed side frame member and the overhead frame member; and an articulated bottom frame member that is displaceable between a position in which it is received within the travel path along the fixed side frame member and at least partly within the travel path of the overhead frame member when the screen is open, and a position in which it is at least largely withdrawn from the overhead travel path and the side frame member travel path whereby the bottom frame member extends parallel to the overhead frame member spaced away there from when the screen is closed.

The articulated bottom frame member may have a length exceeding that of the vertical side frame member. Correspondingly the horizontal overhead frame member may have a length greater than that of the vertical side frame member. For example, for architectural openings such as for bi-fold doors.

The screen apparatus may include any one or more of the features defined and described in the first aspect of the invention.

The invention also provides a method for screening off an architectural opening having a horizontal length that exceeds its vertical height, the method includes:

providing an overhead frame member defining an overhead travel path along an upper edge of the architectural opening that extends substantially the full length of the architectural opening;

providing a fixed side frame member defining a side travel path in communication with the overhead travel path along a side of the architectural opening that extends substantially fully along the length of the side of the architectural opening;

providing an articulated bottom frame member that has a length exceeding that of the vertical side frame member; and displacing the articulated bottom frame member from an open position in which it is received within the travel path along the fixed side frame member and at least partly within the travel path of the overhead frame member when the screen apparatus is open, to a closed position in which it extends parallel to the overhead frame member along a bottom edge of the opening to close the screen.

The method may include mounting each of the overhead frame member, and the fixed side frame member around the architectural opening.

The method may include attaching the articulated bottom frame member to the overhead and fixed side frame members.

The method may include providing longitudinally extending support formations within the overhead travel path, for supporting the part of the articulated bottom frame member that is received within the overhead travel path.

The method may include supporting the part of the articulated bottom frame member that enters the overhead travel path with elongated support rails extending longitudinally along the overhead path.

The method may include supporting the screen with hanger members that are attached to the screen, or to a tension chord extending through the screen, the hanger members being slidably displaceable along hanger rails extending longitudinally along the overhead frame member.

The method may include supporting the screen with a plurality of bottom screen attachment formations that are slidably mounted on the articulated bottom frame member, each bottom screen attachment formation being for attachment to the screen or a lowermost tension chord of the screen.

According to another aspect of this invention there is provided a screen apparatus, including:

an elongated overhead frame member having one end and an opposite end;

a transverse fixed side frame member having a lower end and an upper end that is fixedly mounted to the overhead frame member towards said one end, the fixed side frame member defining a side travel path extending longitudinally along the side frame member;

a displaceable side frame member substantially parallel opposite the fixed side frame member that is displaceable towards the fixed side frame member to open the screen and displaceable away from the fixed side frame member to close the screen;

an elongated articulated bottom frame member having one end that is attached towards a bottom end of the displaceable side frame member so that the articulated bottom frame member is displaced with the displaceable side frame member;

a screen member extending between the frame members, the screen member being interchangeable between a collapsed condition when the apparatus is open and an extended condition when the apparatus is closed by movement of the displaceable side frame member; and a plurality of screen attachment formations that are mounted on the overhead and/or bottom frame members for attaching to the screen.

The screen attachment formations may include a plurality of hanger members that are mounted on the overhead frame member within the overhead hanger path, and which can travel along the overhead hanger path by sliding displacement along the hanger rails.

Each hanger member may include a snaring formation for attaching to the screen and/or an uppermost tension chord of the tension chord arrangement for supporting the screen. The snaring formation may have a free end for snaring the screen or tension chord. The snaring formation may be a hook like formation.

The screen attachment formations may also include a plurality of bottom attachment formations that are slidably mounted on the articulated bottom frame member. Each bottom attachment formation may be adapted for attachment to a lowermost tension chord of the tension chord arrangement and/or the screen member for resisting blow-out or push-out of the screen from the upper channel of the articulated bottom frame member.

Each bottom attachment formation may also include a snaring formation having a free end for snaring the screen or tension chord. The snaring formation may be a hook like formation.

The bottom frame member may include a bottom attachment formation travel path. The bottom attachment formation travel path may include bottom side channels on either side of the bottom frame member. The path may be defined in the sides of the links making up the bottom channel frame member. The screen attachment formations may be received within the channels on either side of the links making up the bottom frame member.

In particular each bottom screen attachment formation may be slidably mounted in the travel paths on the two sidewalls of each link making up the bottom frame member. Each bottom attachment formation may be capable of sliding within the bottom side channels thereby to slide relative to the bottom frame member.

The screen apparatus may include any one or more of the features of the screen apparatus defined in the first aspect of the invention above.

According to another aspect of this invention there is provided a screen apparatus, including:

an elongated overhead frame member having one end and an opposite end;

a transverse fixed side frame member having a lower end and an upper end that is fixedly mounted to the overhead frame member towards said one end, the fixed side frame member defining a side travel path extending longitudinally along the side frame member;

a displaceable side frame member substantially parallel opposite the fixed side frame member that is displaceable towards the fixed side frame member to open the screen and displaceable away from the fixed side frame member to close the screen;

an elongated articulated bottom frame member having one end that is attached towards a bottom end of the displaceable side frame member so that the articulated bottom frame member is displaced with the displaceable side frame member;

a screen member extending between the frame members, the screen member being interchangeable between a collapsed condition when the apparatus is open and an extended condition when the apparatus is closed by movement of the displaceable side frame member;

a plurality of screen attachment formations that are mounted on the overhead and/or bottom frame members for attaching to the screen, wherein the screen attachment formations include a captured member for attachment at one end to the screen and at another end to the overhead and/or bottom frame members.

Preferably, the screen attachment formations may include a plurality of captured members that may be mounted on the overhead frame member within the overhead hanger path, and which may travel along the overhead hanger path by sliding displacement along the hanger rails.

Preferably, the screen attachment formations may further include a plurality of captured members that may be slidably mounted on the articulated bottom frame member.

Preferably, the screen apparatus further includes at least one stiffening member extending between the frame members and running substantially parallel with the screen member, the stiffening member may be adapted for resisting blow-out or push-out of the screen.

The screen apparatus may include any one or more of the features of the screen apparatus defined in the first aspect of the invention above.

DETAILED DESCRIPTION OF THE PREFERRED EMBODIMENTS

A pleated screen apparatus in accordance with this invention may manifest itself in a variety of forms. It will be convenient to hereinafter describe at least one embodiment of the invention in detail with reference to the accompanying drawings. The purpose of providing this detailed description is to instruct persons having an interest in the subject matter of the invention how to carry the invention into practical effect. However it is to be clearly understood that the specific nature of this detailed description does not supersede the generality of the preceding broad description. In the drawings:

Figure 1:
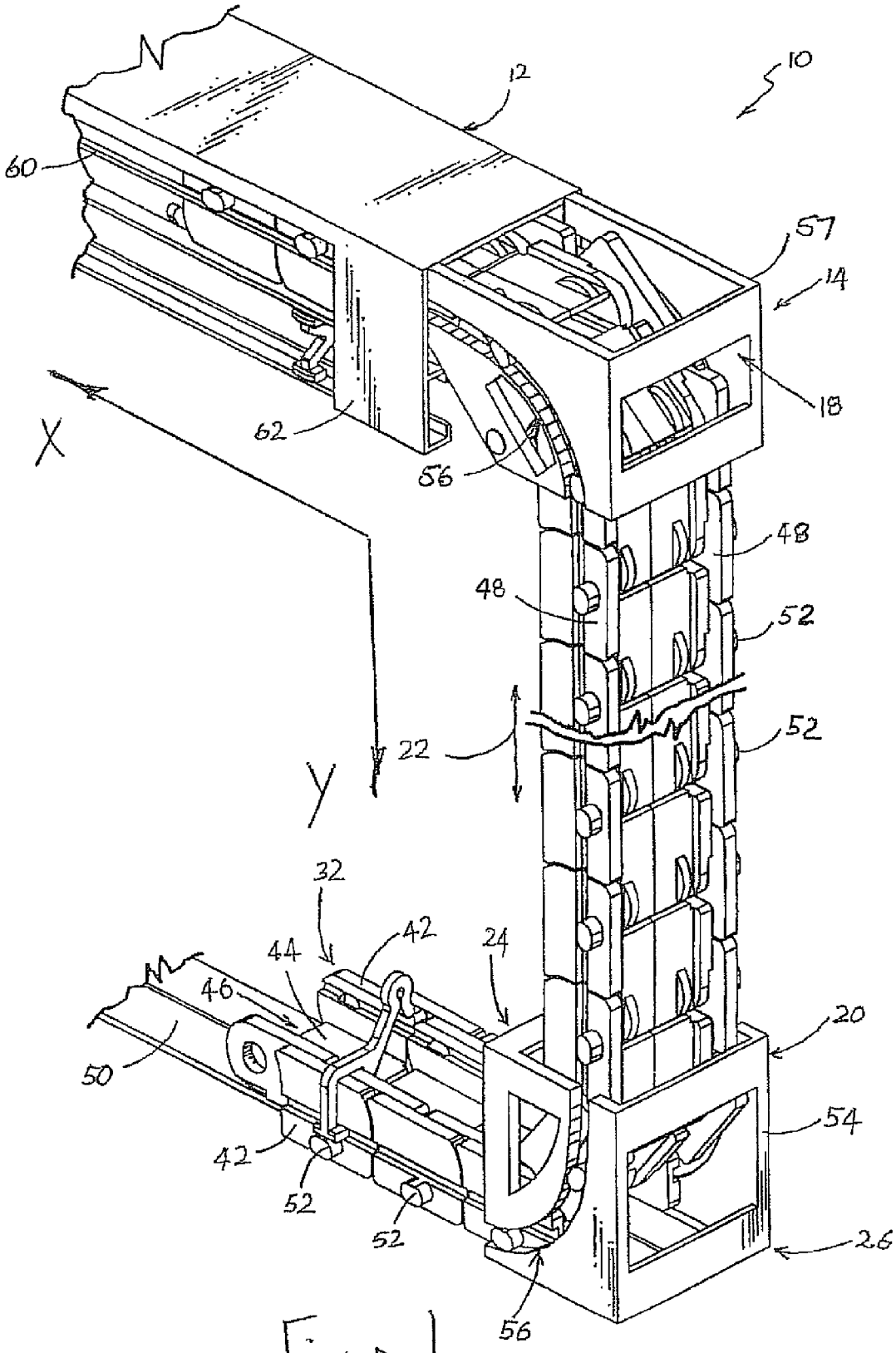
FIG. 1 is a three dimensional view of part of a frame of a pleated screen apparatus, in accordance with one embodiment of the invention, with some details omitted for clarity.
Figure 2:
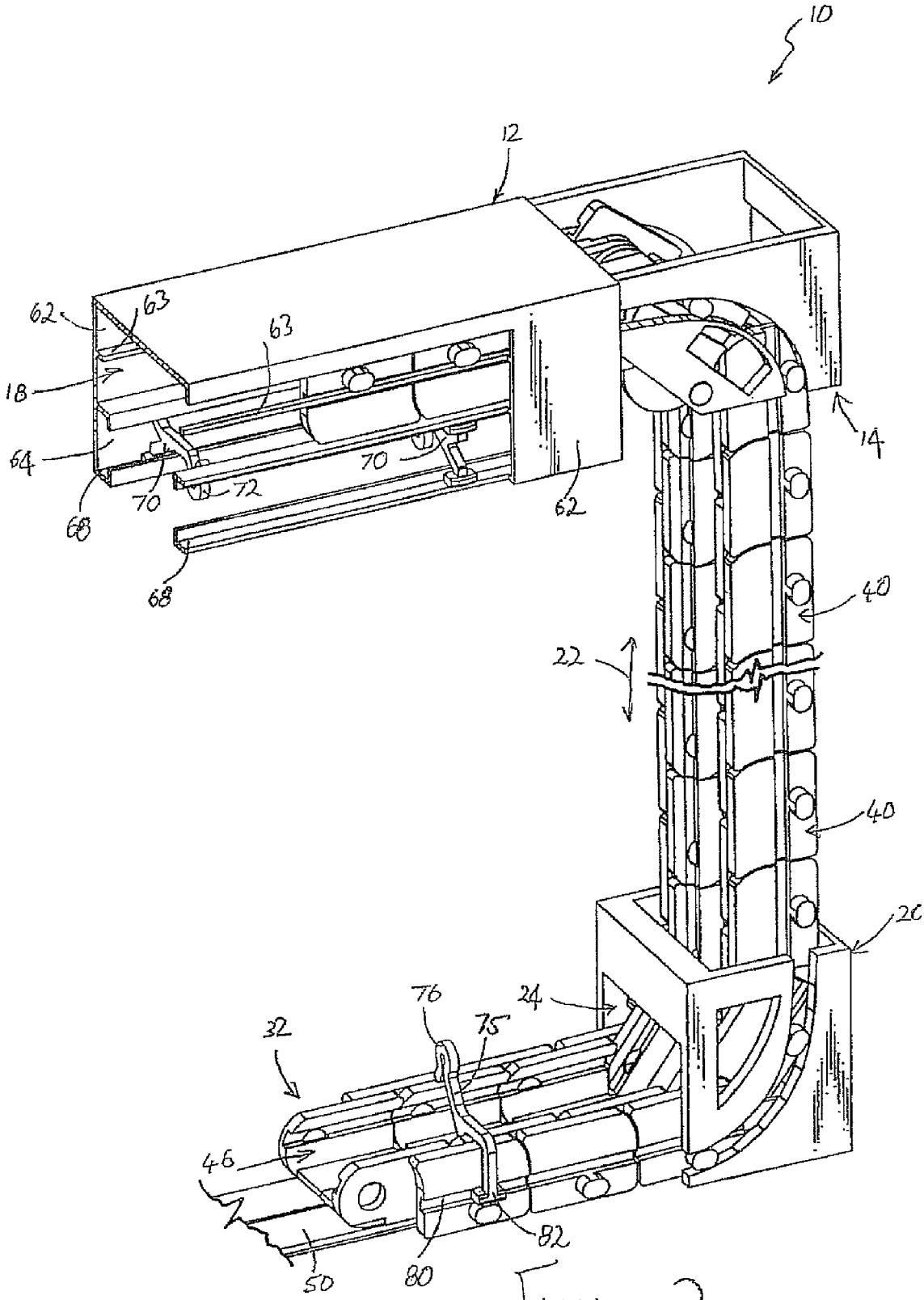
FIG. 2 is a three dimensional view of the pleated screen apparatus of FIG. 1 shown from another direction and again with details omitted for clarity.
Figure 3:
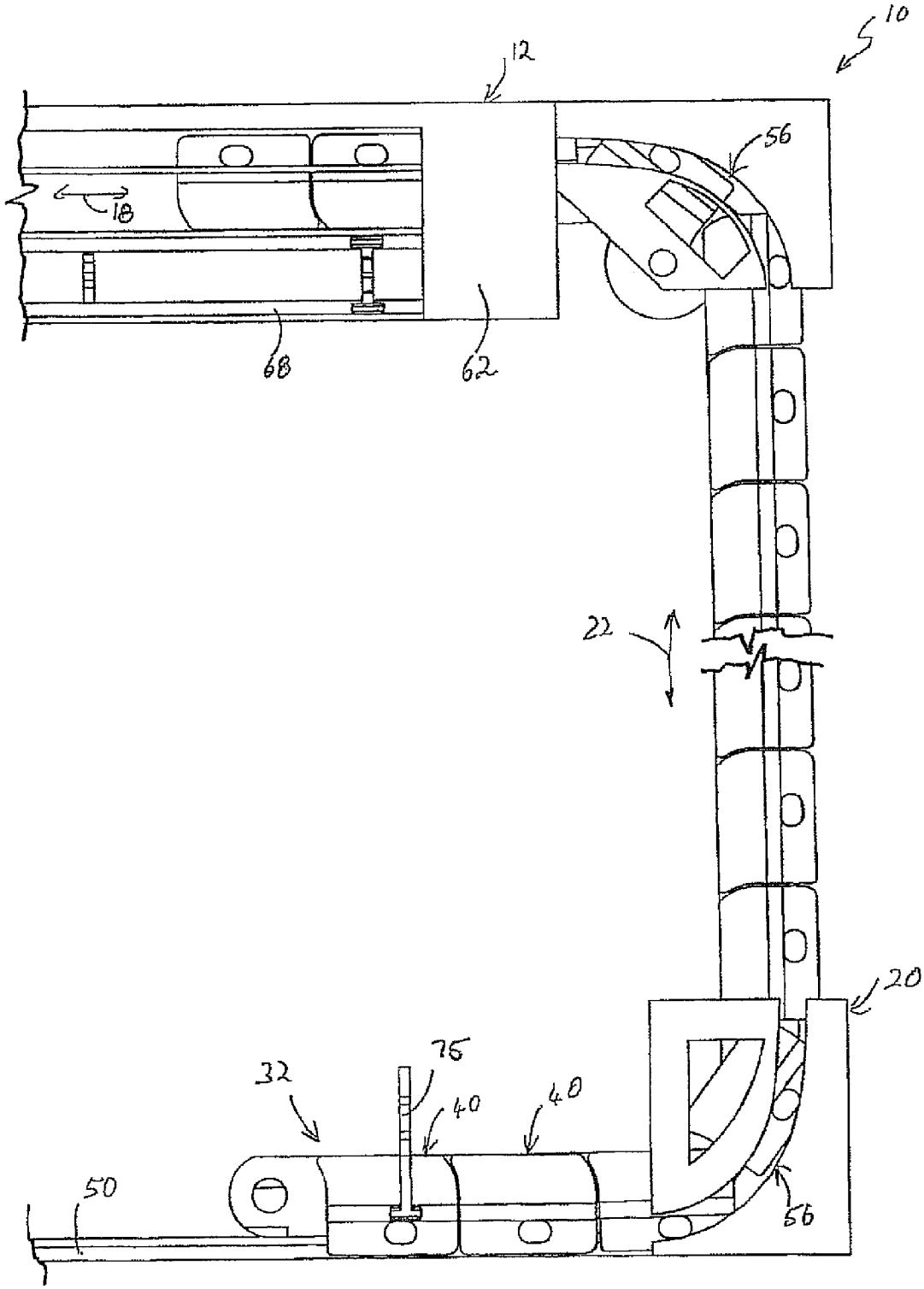
FIG. 3 is a sectional front view of the pleated screen of FIG. 1, again with some details omitted for clarity.

In FIGS. 1 to 3, reference numeral 10 refers generally to a pleated screen apparatus, in accordance with the invention. Some structure of the screen apparatus 10 has been omitted from these drawings to assist in showing the structure and function of the apparatus. The screen apparatus 10, in this example is an insect screen apparatus for screening off insects from passing though an architectural opening by providing a barrier resisting flying insects from passing there through.

The screen apparatus 10 has a longitudinal length, indicated by reference numeral X that is greater in dimension than its transverse dimension which is the height of the door or window opening, indicated by reference numeral Y. Thus, the screen apparatus 10 can be used for screening off an oblong door or window opening that has its long axis extending in a horizontal direction.

The pleated screen apparatus 10 includes an elongated overhead frame member 12 having one end, at 14, and an opposite end, at 16. The overhead frame member 12 defines an interior overhead travel path 18 that extends in a longitudinal direction along its length.

The pleated screen apparatus 10 also includes a transverse fixed side frame member or fixed upright 20, extending transverse to the overhead frame member 12, part of which is shown in FIG. 1. The fixed upright 20 is fixedly mounted towards said one end, at 14, of the overhead frame member 12. Typically the fixed upright 20 is mounted against an upright side surface of a wall that defines the door or window opening.

The fixed upright 20 defines lengthwise a side travel path 22 that is in communication with or joins up to the overhead travel path 18. The side travel path 22 has a side path opening 24 that is located towards a bottom end, at 26, of the fixed upright 20.

Figure 4:
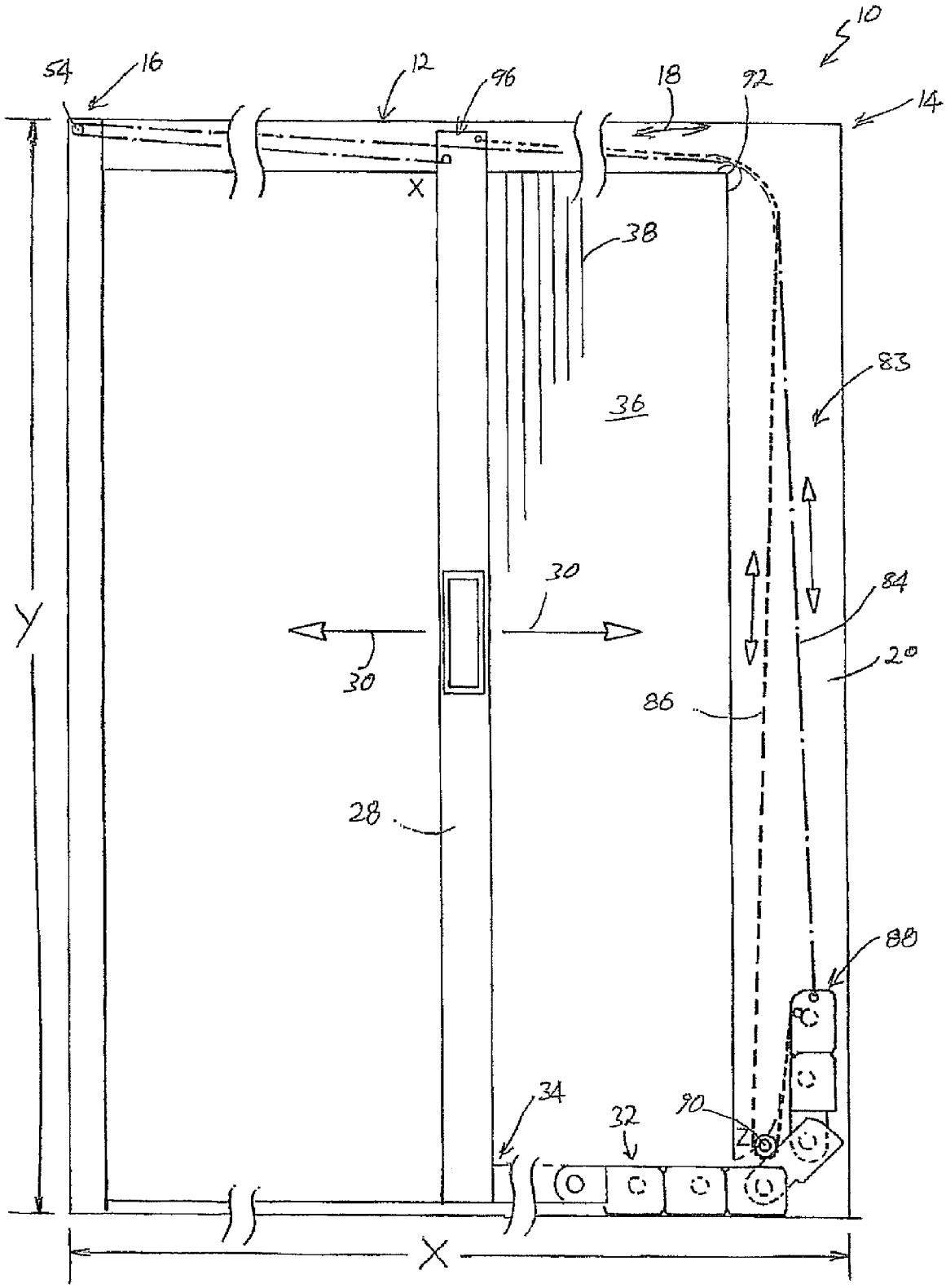
FIG. 4 is a sectional front view of part of the pleat screen of FIG. 1 showing an articulated bottom frame member and the manner in which it is attached to a displaceable side frame member and a fixed side frame member.
Figure 5:
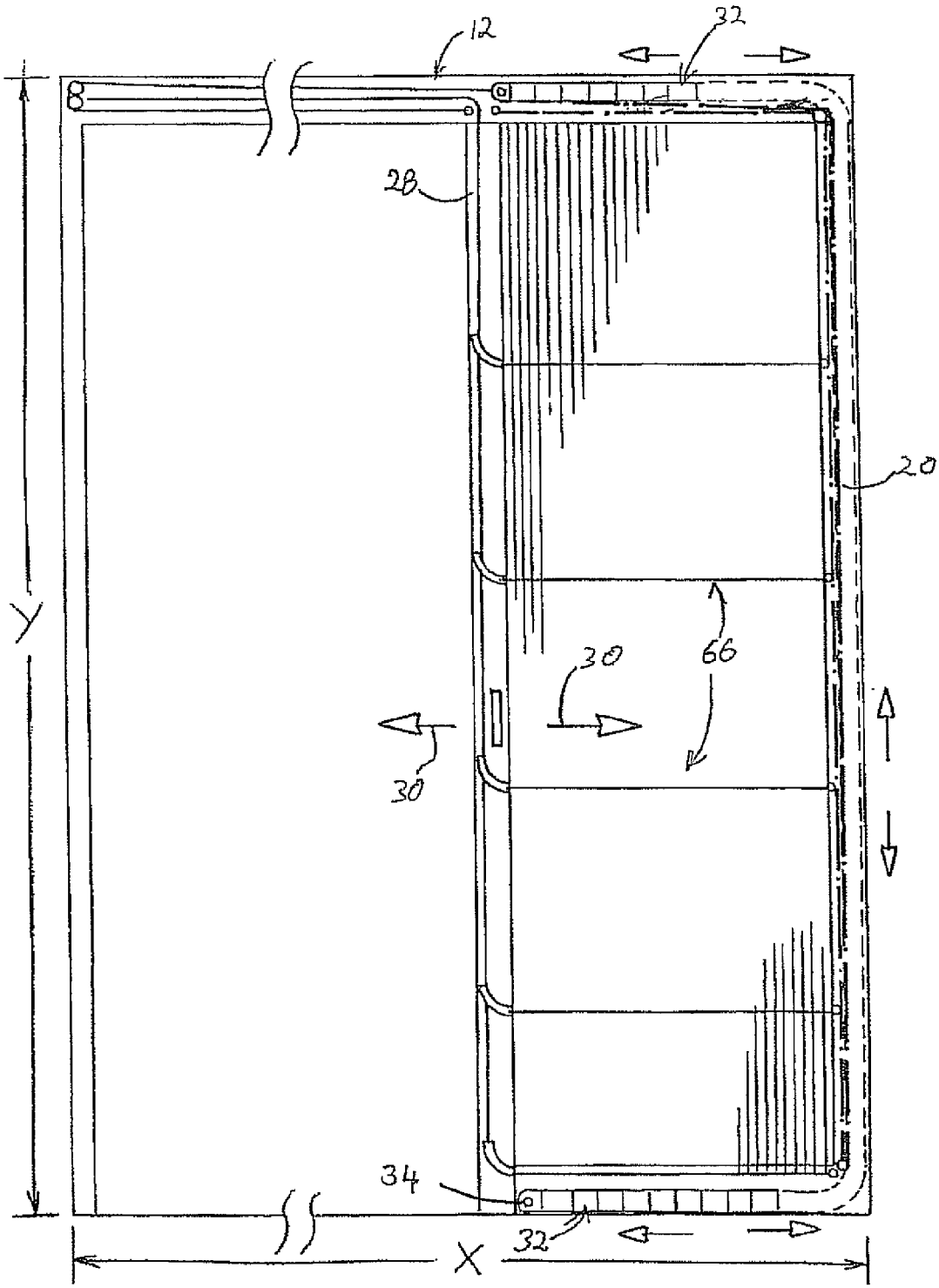
FIG. 5 is a further sectional front view of the pleated screen apparatus of FIG. 1 showing how the articulated bottom frame member is attached to the displaceable side frame member and the fixed side frame member.
Figure 6:
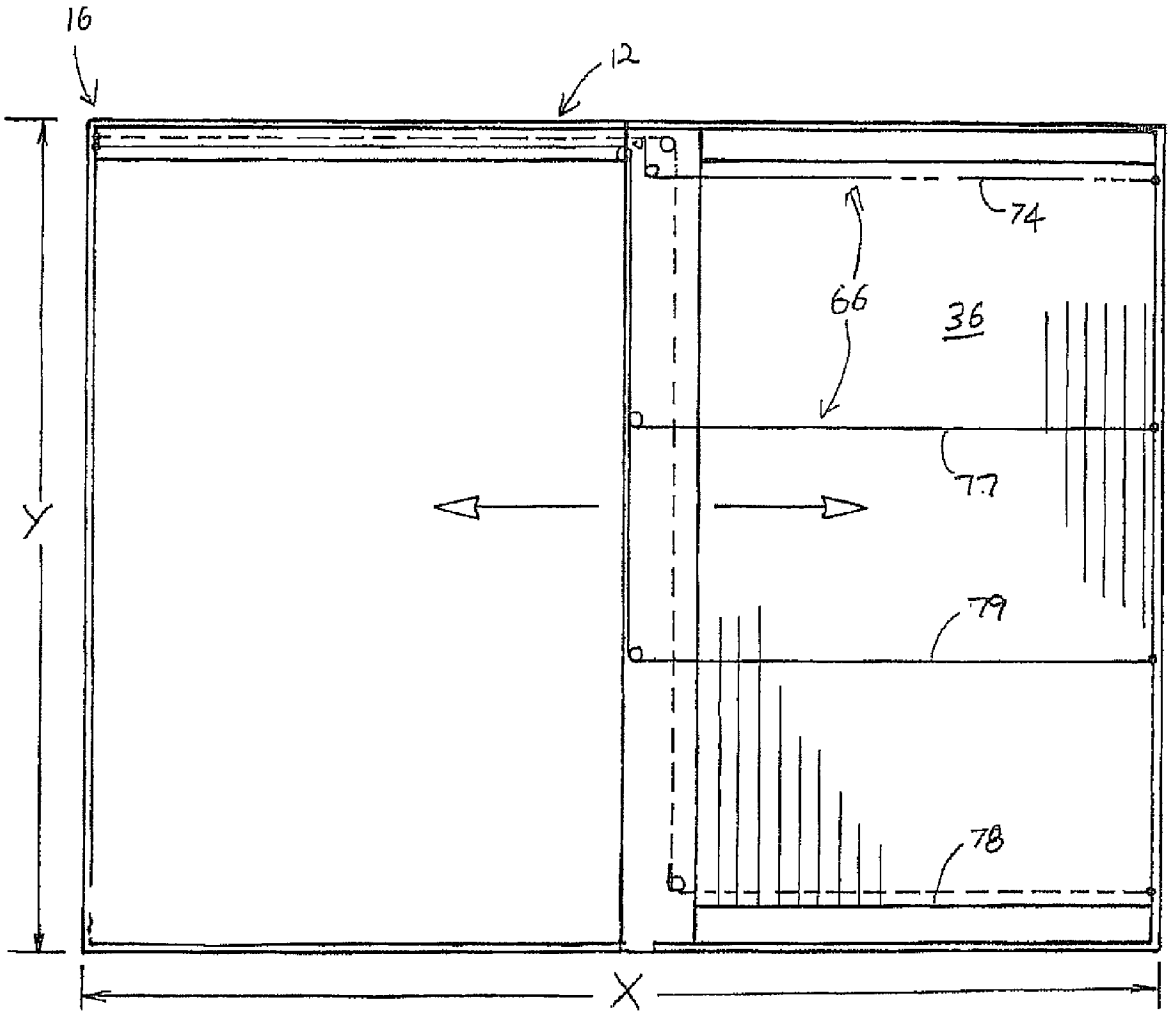
FIG. 6 is a schematic front elevation of the pleated screen apparatus showing how tension cord wires are used to support the pleat screen.

The screen apparatus 10 also includes a displaceable side frame member or upright 28 (see FIG. 4) substantially parallel to the fixed upright 20 that is displaceable towards the fixed side upright 20 to open the screen and away from the fixed upright 20 to close the screen. This movement towards and away from the fixed upright 20 is indicated in the drawings by the arrow 30.

The screen apparatus 10 further includes an elongated articulated bottom frame member or caterpillar track, generally indicated by reference numeral 32. The bottom frame member 32 has one end, 34, that is attached to the displaceable upright 28 towards a bottom end thereof. This way the caterpillar track 32 attached to the displaceable upright 28, is displaceable with the displaceable upright 28 when it is moved to interchange the screen between spread and folded conditions or open and closed conditions.

As described above, in the illustrated embodiment the length of the opening is greater than the height. As a result the overhead frame member 12 and the caterpillar track 32 has a length that is greater than the vertical height of the fixed upright 20. Consequently, not all of the length of the caterpillar track 32 can be received within the side travel path 22 of the fixed upright 20 as it has insufficient length to receive the full length of the track 32. At least part of the caterpillar track 32 is capable of being received within the overhead travel path 18. Accordingly when the displaceable upright 28 is positioned closely, say adjacent, to the fixed upright 20 then the caterpillar track 32 extends from the bottom end of the displaceable upright 28 through the path opening 24 along the side travel path 22 and into the overhead travel path 18 of the overhead frame member 12. The extent to which the caterpillar track 32 is received within the overhead travel path 18 of the overhead frame member 12 depends on the extent to which the bottom frame member 32 or overhead frame member 12 is longer than the side frame member 20.

The screen apparatus 10 also includes an apertured screen member that is a screen 36 extending between the frame members 12, 20, 32, 28. The screen 36 is formed from a mesh and the longitudinal length of the screen 36 is greater than its transverse width when extended so as to cover the oblong door or window opening when extended.

The screen 36 is collapsible in a horizontal direction between the side frame members 20, 28 as the side frame members 20, 28 are displaced towards each other to open the screen 36. The screen 36 is extendible or spreadable as the side frame members 20, 28 are moved away from each other to close the screen 36.

This screen 36 includes a plurality of longitudinally spaced apart transverse fold lines or pleats 38. The screen 36 folds along the fold lines 38 as the displaceable upright 28 is displaced towards the fixed upright 20. Thus the screen 36 is collapsed by folding it along each of the fold lines or pleats 38.

The articulated bottom frame member or caterpillar track 32 includes a plurality of contiguous link members 40 arranged end to end in a line not unlike links of a bicycle chain. Collectively the link members 40 are connected contiguously to define a caterpillar track 32. Each link member 40 is rigid and adjacent link members 40 are pivotally attached to each other about transverse pivot axes thereby to enable the bottom frame member or caterpillar track 32 to bend in sequence along its length whereby to enable it to change direction.

Each link member 40 includes transversely spaced apart opposing link sidewalls 42 and a link web 44 extending transversely between the sidewalls 42 intermediate upper and lower edges of the link sidewalls 42. An open channel 46 is thus defined between upper portions of the link sidewalls 42 and the link web 44. The channel 46 faces upwardly while the bottom frame member 32 extends along the bottom of the door or window opening. A lower end portion of an extended part of the screen 36 is received, in use, within the channel 46.

The overhead frame member 12 includes longitudinally extending link member guides 63 in the form of longitudinally extending opposing shoulder rails provided on insides of side walls 62 of the overhead frame member 12 for cooperating with the link members 40 when part of the caterpillar track 32 is received within the overhead frame member travel path 18.

In the illustrated embodiment the link member guides 63 comprise channels defined in the side walls 62 of the frame member 12 defining the shoulder rails for supporting the link members 40.

The side frame member 20 also includes longitudinally extending link member guides 63 in the form of longitudinally extending opposing shoulder rails provided on insides of side walls 62 of the fixed upright 20. The link member guides 63 in the fixed upright 20 may be very similar to those on the overhead frame member 12.

The apparatus 10 includes a track rail 50 provided on a support surface, or floor, above which the screen apparatus 10 is installed. Each link member 40 making up the bottom frame member 32, and specifically the side walls 42 thereof, have a lower part 48 that forms a retainer formation that cooperates with the track rail 50 to guide travel of the caterpillar track 32 and the movable side member 28 along the support surface.

The caterpillar track 32 also includes a plurality of longitudinally spaced apart transversely projecting guide formations 52. The guide formations 52 cooperate with the complementary shaped guide paths 63 or slots 56 defined by the fixed upright 20 and the overhead frame member 12. Each link member 40 includes two guide formations 52 in the form of stubs that project transversely outwards away from each other from their associated link sidewalls 42.

The fixed upright 20 has a bottom portion 54 that defines a curved guide slot 56 that curves through an angle of 90 degrees. The curved guide slot 56 receives the stubs 52 of the link members 40 that enter the path opening 24 of the fixed upright 20 in a horizontally extending direction and guides displacement of the link member 40 though 90 degrees into the vertically extending side travel path 22.

Similarly, the fixed upright 20 also has an upper portion 57 defining opposing curved guide slots 56 that curve through an angle of 90 degrees for receiving the stubs 52 of the link members 40 and for guiding the link members 40 through the change of direction from vertically extending to horizontally extending. This occurs for example, when the caterpillar track 32, and in particular a link member 40 thereof, is displaced through the corner portion formed between the fixed upright 20 and the overhead frame member 12 from the vertically extending side path 22 into the horizontally extending overhead path 18.

The screen apparatus 10 also includes a tension chord arrangement that is generally indicated by reference numeral 66, for supporting the screen 36 tautly when it is extended.

The overhead frame member 12 defines another longitudinally extending hanger travel path 64 below the overhead travel path 18. The further hanger travel path 64 is formed by sidewalls 62 and is arranged for receiving a plurality of hanger members 70 that are slidably displaceable along the hanger rails 68. Each hanger member 70 includes a snaring formation 72 in the form of a hook for attaching to an uppermost tension chord 74 and/or the screen member 40 of the tension chord arrangement 66.

The screen apparatus 10 also includes a plurality of bottom attachment formations 75 that are slidably mounted on link sidewalls 42 of the caterpillar track 32. Each screen attachment formation 75 includes a snaring formation 76 in the form of a hook for attaching to a lowermost tension chord 78 of the tension chord arrangement 66. The link sidewalls 42 define longitudinally extending slots 80 within which two spaced mounting feet 82 of each bottom screen attachment formation 75 can be slidably received.

The tension chord arrangement 66 in this example includes four chords 74, 77, 78, 79. Each chord 74, 77, 78, 79 is attached towards the opposing end 16 of the overhead frame member 12 and extends horizontally towards an upper end of the displaceable upright 28 and vertically downwards into the displaceable uprights 28 and horizontally out of the displaceable upright towards the fixed upright 20 to which its associated end is connected. The tension cords are slidably laced through the mesh screen 36. The tension chords 74, 77, 78, 79 extend downwards into the displaceable upright member 28 and exits the displaceable upright member 28 at longitudinally spaced intervals so that the screen 36 is supported at said spaced intervals. The chords 74, 77, 78, 79 can be engaged with the hanger members 70 and the bottom screen attachment formations 75.

The screen apparatus 10 also includes a pull chord arrangement, generally indicated by reference numeral 82, for facilitating pulling displacement of the caterpillar track 32 along the side travel path 22 and the overhead travel path 18. One cord pulls the track 32 into the side and overhead travel paths 22 and 18 and the other pull cord pulls the caterpillar track 32 out of the side and overhead travel paths 22 and 18.

The pull chord arrangement 83 includes two chords 84 and 86. Both pull chords 84, 86 extend between the opposing end, at 88, of the caterpillar track 32 and an upper end, at 96, of the displaceable upright 28.

The one pull cord 86 is attached to the upper end, at 96, of the displaceable upright 28 and routed along the overhead frame member 12 towards the fixed upright 20 downwards along the fixed upright 20 towards a lower end of the fixed upright 20 around a return surface or pulley 90 with its other end attached to the opposing end, at 88, of the caterpillar track 32.

The other pull chord 84 is attached with its one end to the upper end, at 96, of the displaceable upright 28, and extends toward the opposite end 16 of the overhead frame member 12 and returns around a return surface or pulley 54, and extends further along the overhead path 18 and the side path 22 with its other end attached to the opposed end 88 of the caterpillar 32.

This arrangement of the pull chords 84, 86 causes the one pull cord 86 to pull the caterpillar track 32 away from the overhead path 18 and the side path 22 when the displaceable upright is displaced away from the fixed upright 20. The other pull chord 84 causes the caterpillar track 32 to be pulled towards the overhead path 18 and the side path 22 when the displaceable upright 28 is displaced towards the fixed upright 20.

The track rail 50 in FIGS. 1 to 3 has a generally flat square transverse profile so that the track rail 50 is straddled by the retainer formations 52.

In use, the pleated screen apparatus 10 might typically be used to screen off a door opening leading from the interior of a dwelling out onto an outdoor entertainment or living area. The door opening has a greater opening width or opening length than the height of the opening, e.g. of the type which might be closed off by sliding doors or bifold doors.

Typically the screen apparatus 10 might be kept in an open position as a default position when the area is not being used.

In the open position the displaceable upright 28 is positioned adjacent the fixed upright 20, and the pleated screen mesh 36 is fully collapsed between the uprights 20, 28. In this configuration the caterpillar track 32 extends from the lower end, at 34, of the displaceable upright through the path opening 24 upwards along the side path 22 around the corner portion 14 into the overhead path 18 of the overhead frame member 12.

When a user wishes to screen off the door or window opening with the screen apparatus 10, the displaceable upright 28 is manually displaced by a user away from the fixed upright 20. When this occurs, the caterpillar track 32 moves in sympathy with the displaceable upright 28 out of the opening at the bottom end 26 of the fixed upright by virtue of its attachment to the bottom end of the displaceable upright 28. In addition the pull chord 86 that is attached to the upper end, at 96, of the displaceable upright 28 pulls on the caterpillar track 32 at its end, at 88.

This causes the caterpillar track 32 to be pulled progressively out of the side and overhead travel paths 18, 22 and out of the side travel path opening 24. As the caterpillar track 32 emerges from the opening 24 it is guided along the track rail 50 which guides the displaceable member 28 and the caterpillar track 32.

At the same time, the screen mesh 36 that is attached to the displaceable upright 28 is spread open. The lower end portion of the extended part of the screen mesh 36 is received inside the upper channel 46 of the part of the caterpillar track 32 adjacent it.

When the screen apparatus 10 is opened, the displaceable upright 28 pushes the caterpillar track into the side path 22, and the other pull chord 84 pulls the caterpillar track 32 up the side path 22 and into the overhead path 18 of the overhead frame member 12.

Figure 7:
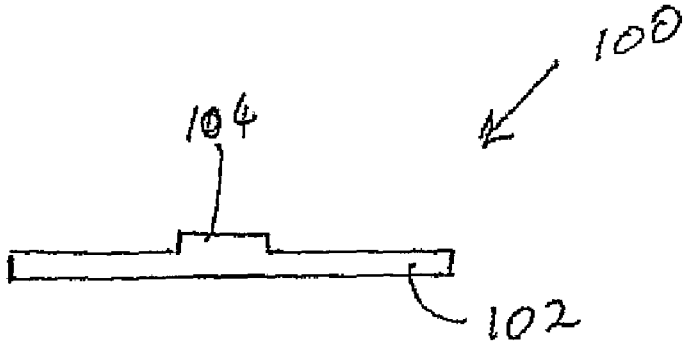
FIG. 7 is a transverse sectional view of one track rail that may be used with a screen apparatus.

FIG. 7 shows a track rail 100 in accordance with another embodiment of the invention.

In FIG. 7 the track rail 100 has a different transverse profile to that shown in the earlier embodiment. In particular the transverse profile includes a flat square shaped base portion 102 and an upwardly projection square shaped upper portion 104 intermediate side edges of the base portion 102. In such case an associated caterpillar track would be profiled in a complementary manner for cooperating with the track rail 100.

Figure 8:
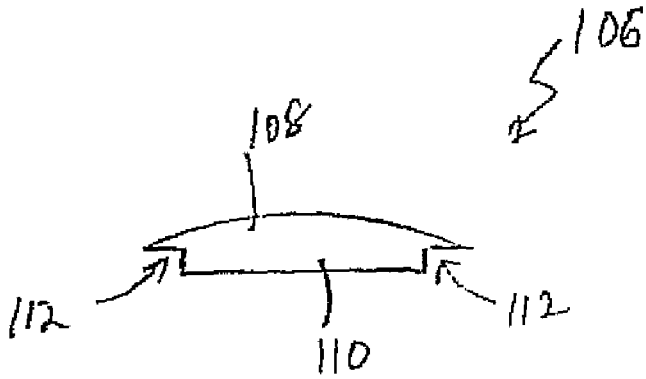
FIG. 8 is transverse section view of another track rail that may be used with the screen apparatus.

FIG. 8 shows a track rail 106 in accordance with yet another embodiment of the invention.

In FIG. 8 the track rail 106 has a different transverse profile to that shown in the earlier embodiment. In particular the transverse profile has an upwardly convex upper transverse profile portion 108 that is supported on a square shaped base portion 110 intermediate side edges of the upper portion so that two cutaways 112 are defined. In this case, an associated caterpillar track would be shaped so as to include a complementary longitudinally extending inwardly projecting opposing lips that cooperate with the cutaways 112 for sliding displacement along the cutaways 112.

Figure 9:
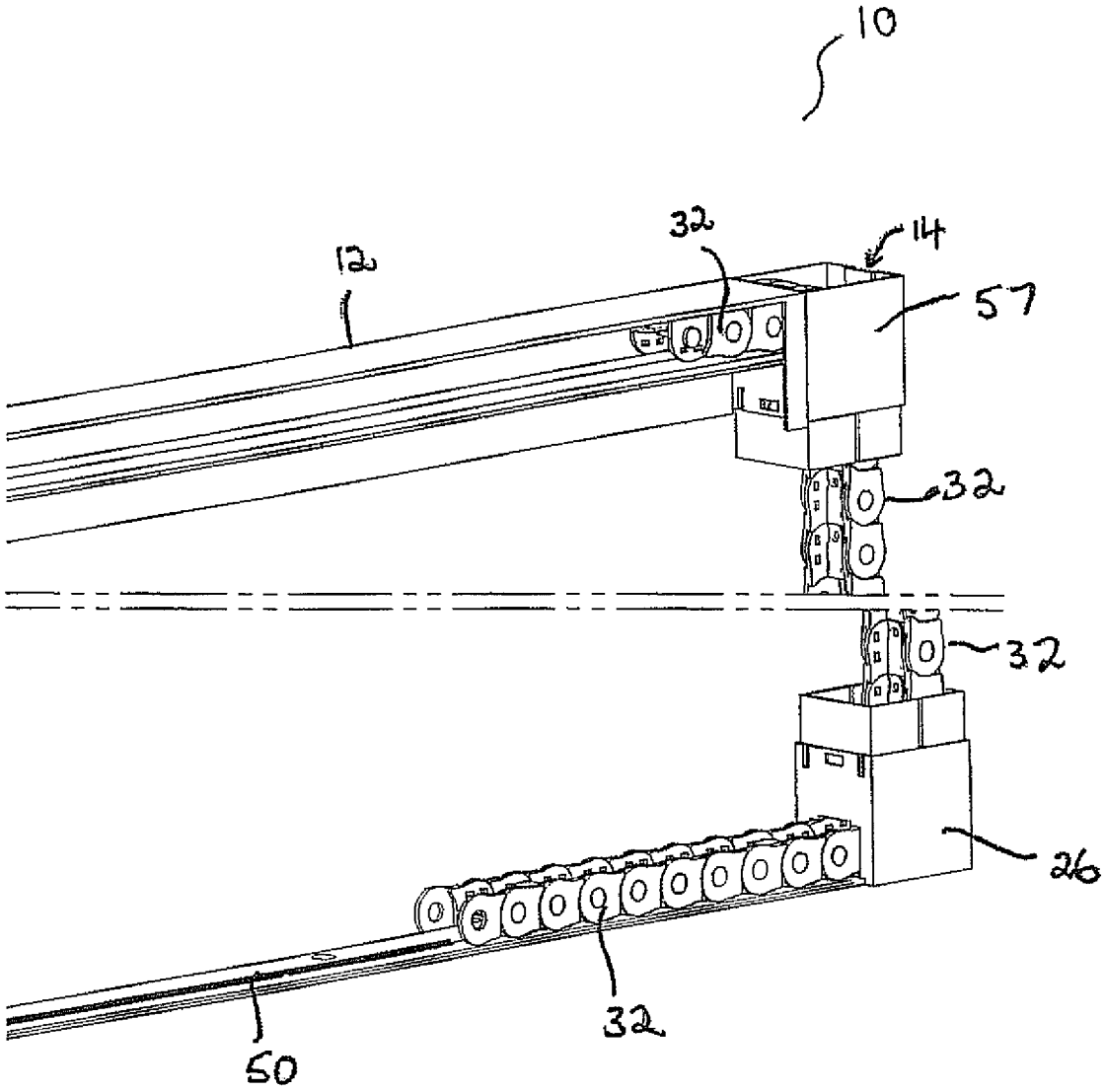
FIG. 9 is a three dimensional view of the pleated screen apparatus of FIG. 1 shown again with details omitted for clarity.

FIG. 9 advantageously shows, the screen apparatus 10 includes a caterpillar track 32 that is receivable inside the side path 22 of the fixed upright 20 via a bottom end 26 and the overhead path 18 via the upper portion 57 of the overhead frame member 12. Thus, the workable length of the caterpillar track 32 is not limited by the length of side path 22 in the fixed upright 20. Therefore, the horizontal distance that the screen can cover is greater than its vertical height. This permits application for a screen apparatus to architectural openings that are oblong with their long axis horizontally. With this structure there is no limit on the width of the opening that can be covered by the pleated screen apparatus.

A further advantage of the screen apparatus 10 is that it includes slidable upper and lower screen support attachment formations 70 and 75 that attach to the uppermost 74 and lowermost 78 tension chords respectively. This resists displacement of the screen mesh 36 away from the frame, for example when the screen is pushed by strong wind or pets.

Another advantage of the screen apparatus 10 is that the link members 40 include guide stubs 52 for guiding the caterpillar track 32 around the 90 degree corners through which it is displaced, in use.

Also, advantageously the apparatus 10 includes a pull chord arrangement 83 for facilitating displacement of the caterpillar track 32 in both directions along the side path 22 and the overhead path 18.

Figure 10:
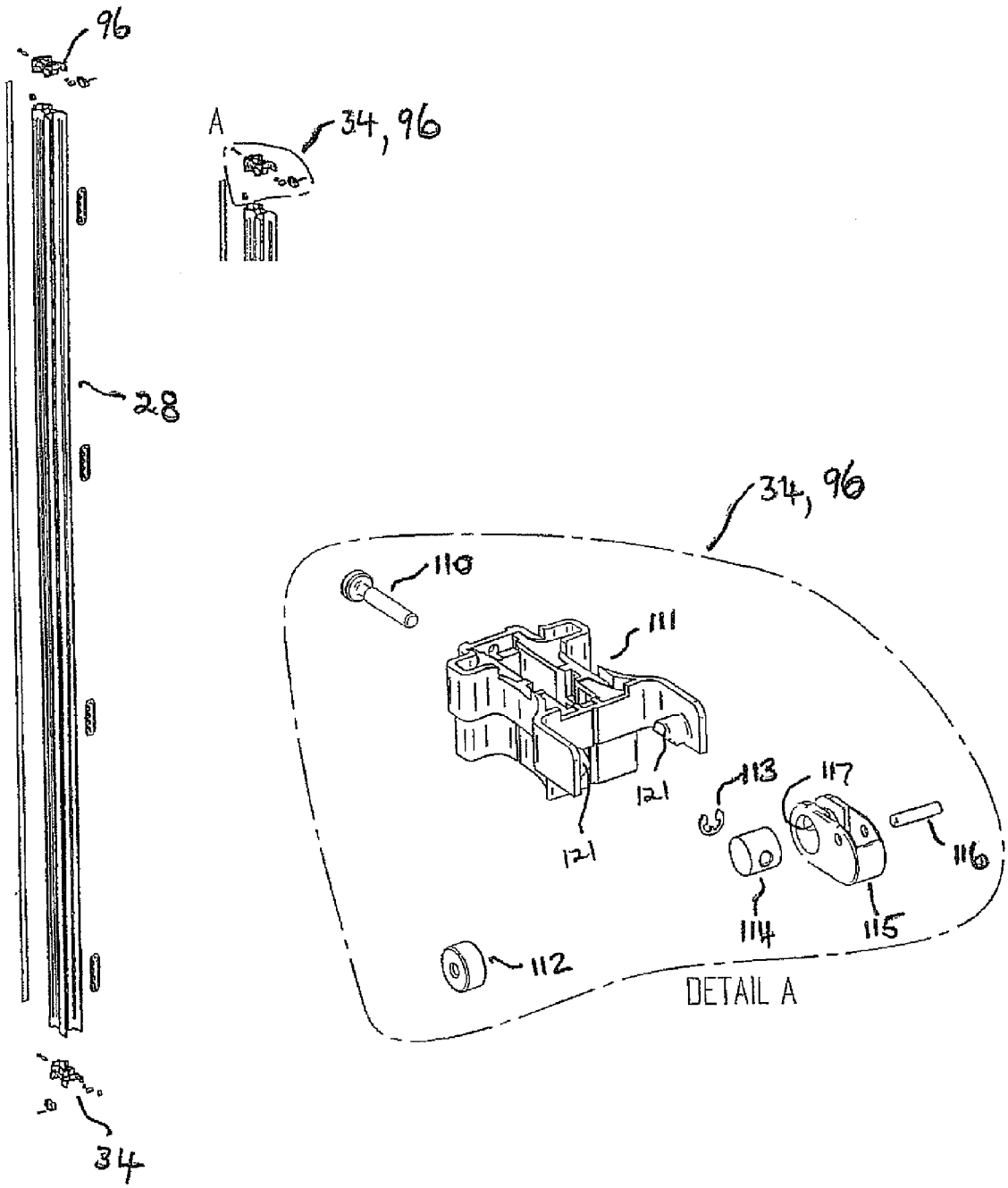
FIG. 10 is a three dimensional view of the displaceable side frame member or upright of FIG. 1 showing the adjustable guides or pulleys in Detail A.

FIG. 10 shows the displaceable side frame member 28 with the adjustable guides 34, 96 located on both end portions of the displaceable side frame member 28. The adjustable guide 34, 96 having a body 111 with a shape complementary to the cross-sectional shape of the displaceable side frame member 28. The complementary shape allows the adjustable guide 34, 96 to be secured on either end of the side frame member 28. Given that both adjustable guides 34, 96 is identical in shape, only one will be described further. The adjustable guide 34 is secured to the side frame member by an elongated pin 110 inserted through a hole in the side frame member 28 and into a recess 120 in the adjustable guide 34. A connector 115 is attached to an end of the caterpillar chain 32 using pin 116. The caterpillar chain 32 is then secured to the adjustable guide 34 by inserting receiving port 151 on either side of the caterpillar chain 32 into each stirrup projection 121. The stirrup connector 121 is located on projection arm 123 on either side of the adjustable guide body 111. The connector 115 is also secured to the adjustable guide body 111 by inserting a cylindrical insert 114 into an aperture 117 within the connector 115 using clip 113 and cylindrical pin 112.

Figure 11:
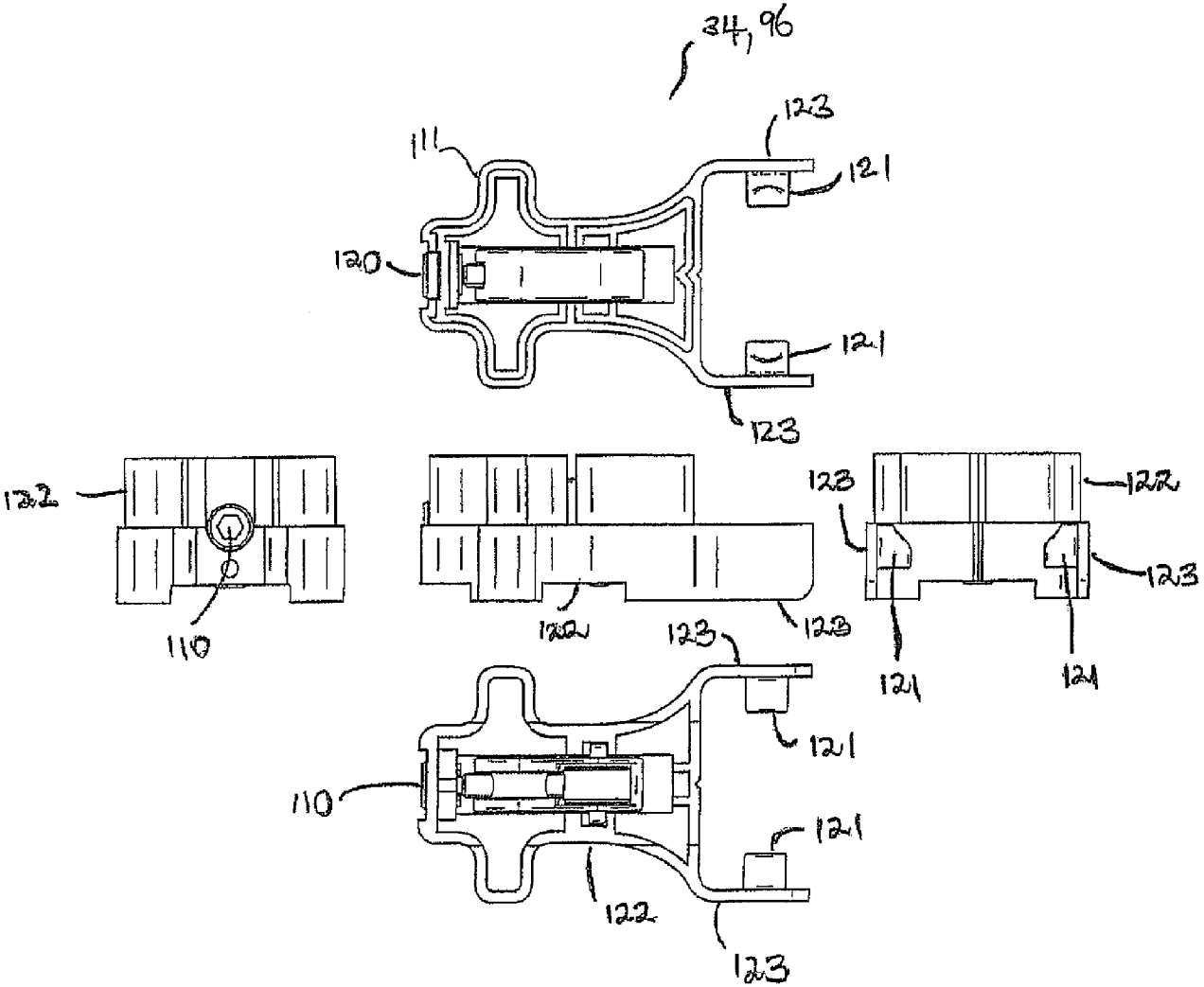
FIG. 11 is a schematic front, side, top and bottom views of the adjustable guide or pulley of FIG. 10.

FIG. 11 shows further detail of the adjustable connectors 34, 96.

Figure 12:
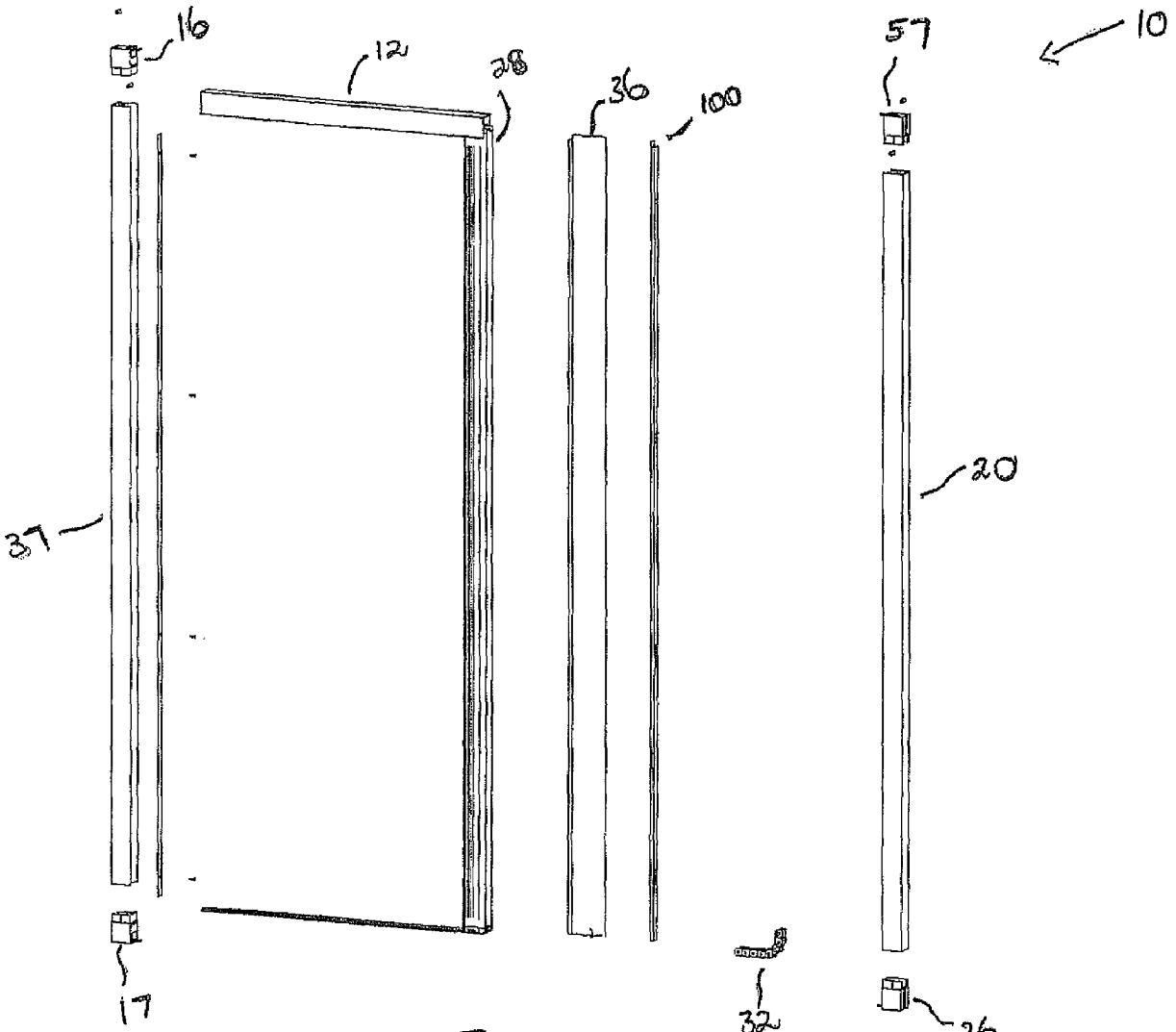
FIG. 12 is an exploded view of a pleated screen according to a further embodiment of the present invention.

FIG. 12 shows a further embodiment of the screen apparatus which includes a stiffening bar 100 and snaring formation 130. The screen 36 includes at least one stiffening member 100 extending between the frame members 12, 32 and running substantially parallel with the screen member 36, the stiffening member 100 is adapted for resisting blow-out or push-out of the screen. For example, the stiffening member 100 resists displacement of the screen mesh 36 away from the frame, for example when the screen is pushed by strong wind or pets. The stiffening member 100 may be a batten or lightweight bar member constructed from a lightweight material and bonded to the screen 36 by a suitable method. The stiffening member 100 stiffens the pleated screen 36.

Figure 14B:
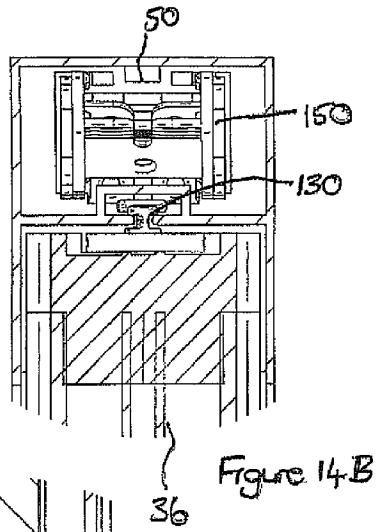
FIGS. 14A and 14B are sectional detailed front views of the attachment of a pleated screen to the link members in accordance with the further embodiment of FIG. 12.
Figure 14A:
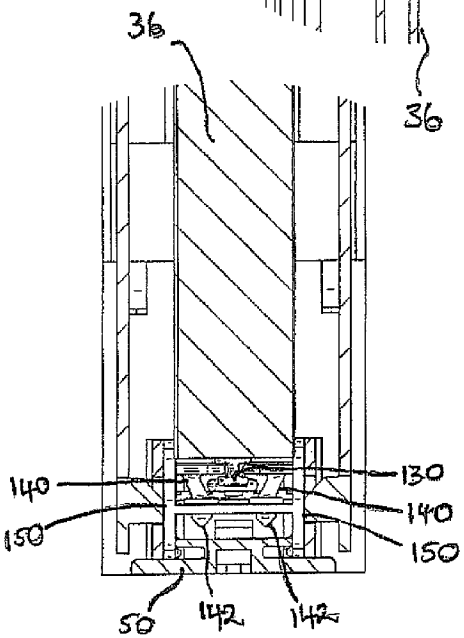
Figure 13:
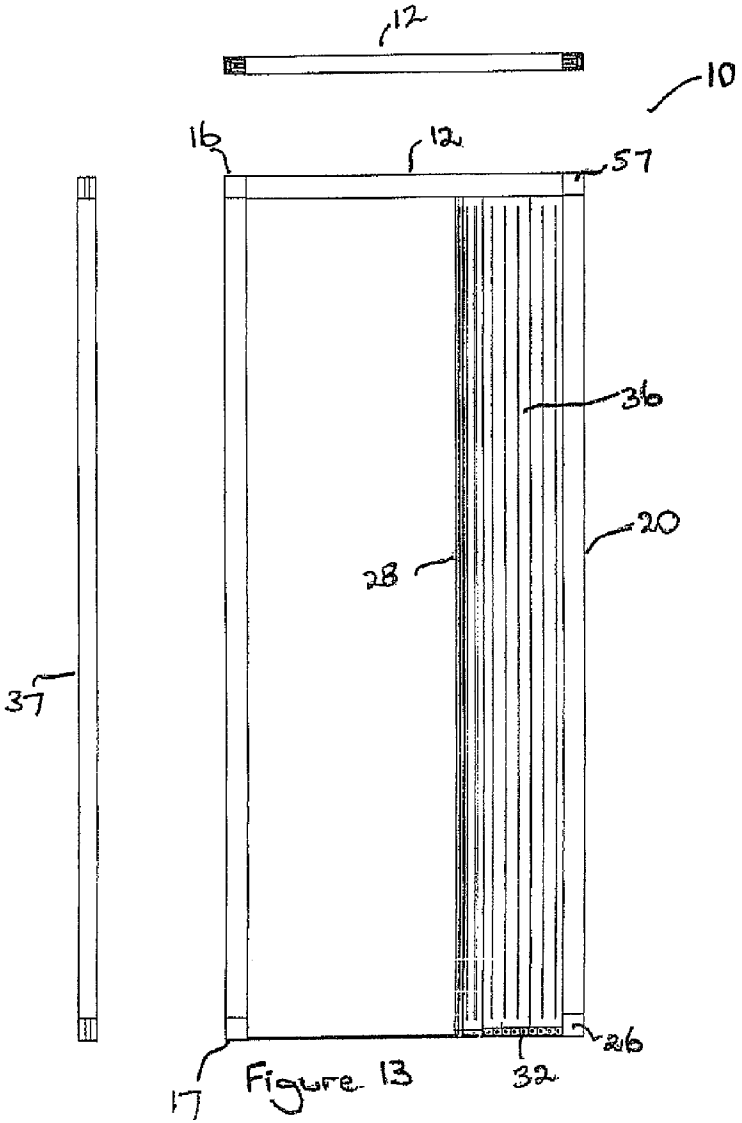
FIG. 13 is a schematic front, side and top view of the pleated screen of FIG. 12.
Figure 15:
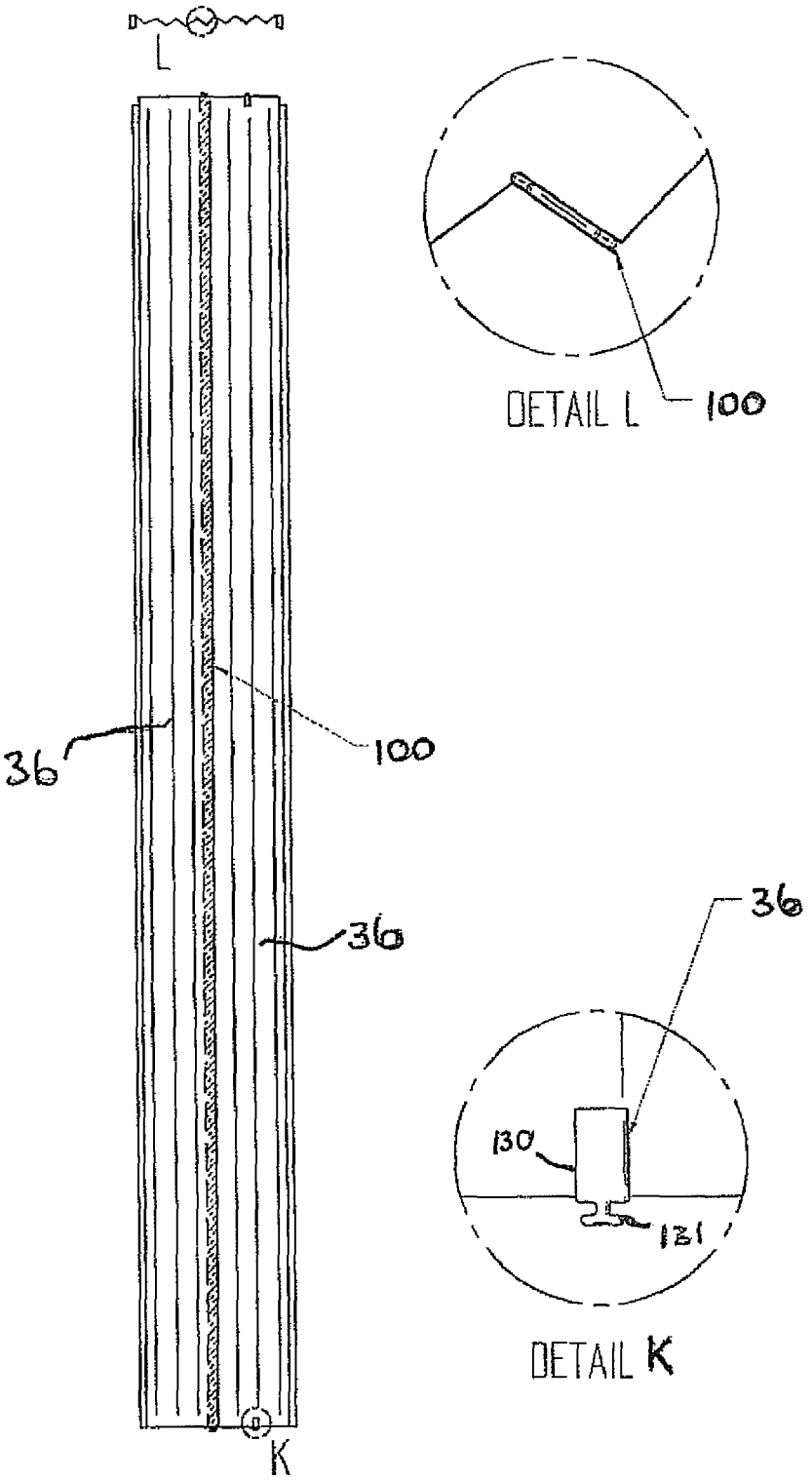
FIG. 15 is a schematic front view of the pleated screen of FIG. 12 showing detailed views of a stiffening bar (Detail L) and a screen pleat clip (Detail K)
Figure 16:
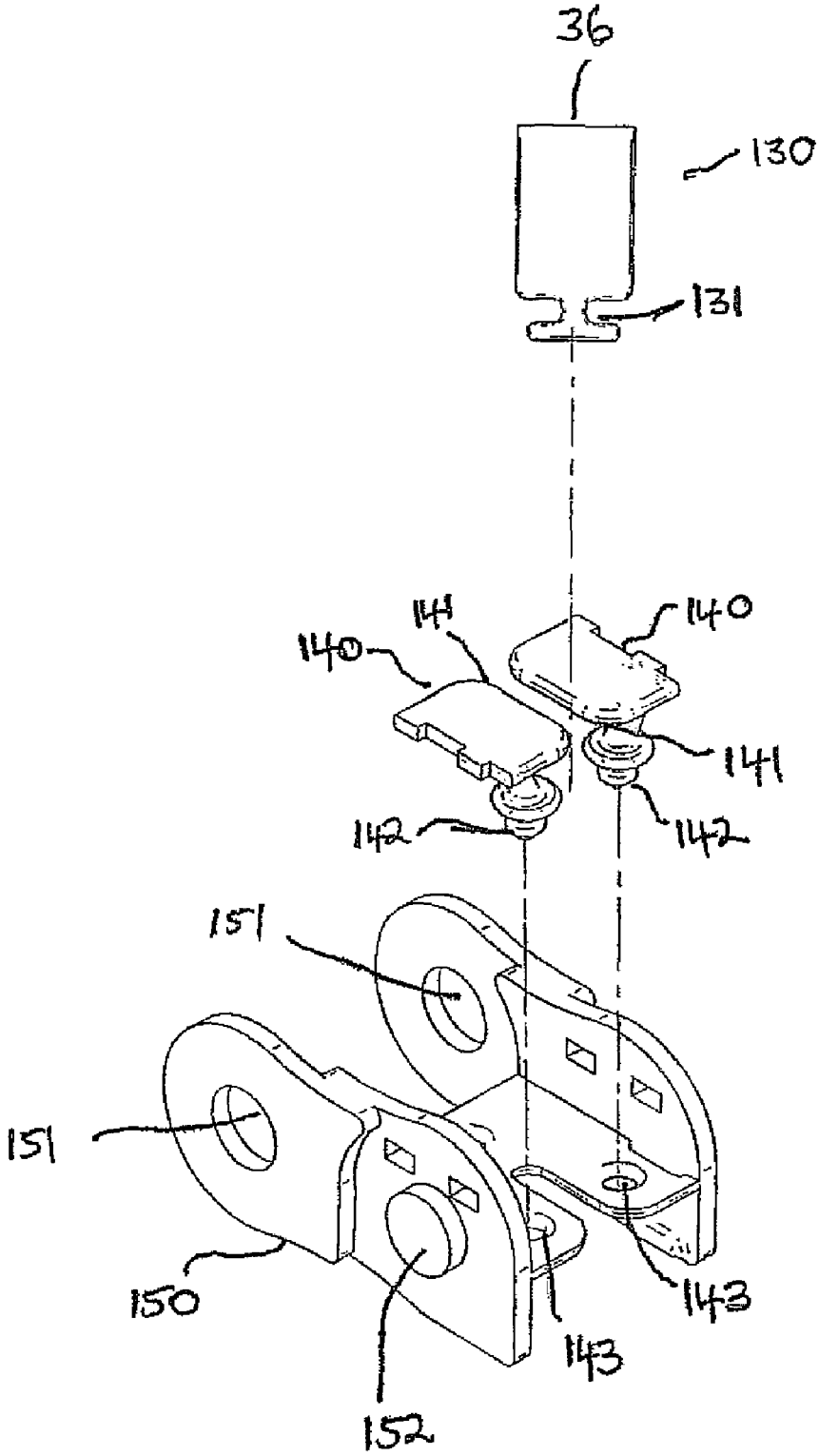
FIG. 16 is an exploded three dimensional view of the of the attachment of a pleated screen to the link members in accordance with the further embodiment of FIG. 12.

FIGS. 14, 15 and 16 show further details of the stiffening member 100 and in particular, the snaring formation 130. FIGS. 14A and 14B show a screen 36 attached to a snaring formation 130 which is constrained within the continuous link member 150. The snaring formation 130 is restrained in the continuous link member 150 by a snaring lock 140 which constrains the captured member 131 of the snaring formation 130.

The snaring formation 130 is secured to the screen 36 by inserting the screen 36 into a gap formed at an opposite end from the captured member 131 of the snaring formation 130. Once the screen 36 is inserted into the gap heat is applied to the joint to weld the screen 36 to the snaring formation 130.

FIG. 16 shows an exploded view of the continuous link member 150, the snaring lock 140 and the snaring formation 130. The captured member 131 of the snaring formation 130 is restrained by the snaring lock 140. The snaring lock consists of projections 142 which are inserted through the receiving holes 143 in the continuous link member 150. The captured member 131 is restrained against the underside surface of the snaring plate 141 of the snaring lock 140. The snaring formation 130 is secured between the snaring lock 140 and the continuous link member 150 as shown in FIGS. 14A and 14B. The continuous link member 150 has projection guide stubs 152 which are used to secure the next continuous link member 150 via the receiving port 151 on the next continuous link member 150 to form the caterpillar track 32.

It will of course be realised that the above has been given only by way of illustrative example of the invention and that all such modifications and variations thereto, as would be apparent to persons skilled in the art, are deemed to fall within the broad scope and ambit of the invention as is herein set forth.

The invention claimed is:

1. A screen apparatus, which includes:

an elongated overhead frame member having one end and an opposite end, the overhead frame member defining lengthwise an overhead travel path;

a transverse fixed side frame member having a lower end and an upper end that is fixedly mounted to the overhead frame member towards said one end, the fixed side frame member defining a side travel path extending longitudinally up the side frame member, that is continuous with the overhead travel path and that has a travel path entrance towards the bottom end thereof;

a displaceable side frame member substantially parallel to the fixed side frame member that is displaceable towards the fixed side frame member to open the screen and is displaceable away from the fixed side frame member to close the screen;

an elongated articulated bottom frame member having one end that is attached towards a bottom end of the displaceable side frame member so that the articulated bottom frame member is displaced when the screen is moved from the closed to the open position, the articulated bottom frame member having a length that is greater than that of the side travel path so that it enters the side travel path through the travel path entrance, and travels up through the side travel path and then through at least part of the overhead travel path when the displaceable side frame member is displaced towards the fixed side frame member to open the screen apparatus; and a screen member extending between the frame members, the screen member being interchangeable between a collapsed condition when the screen is open and an extended condition when the screen is closed by movement of the displaceable side frame member.

2. The screen apparatus according to claim 1, wherein the screen member is formed from a mesh, and is generally oblong when extended, wherein the longitudinal length of the screen member is greater than its transverse width, and the screen member includes a plurality of longitudinally spaced apart transverse fold lines, so that the screen folds along the fold lines when the displaceable side frame member is displaced towards the fixed side frame member, so that the screen is collapsible concertina-fashion.

3. The screen apparatus according to claim 2, wherein the apparatus is a pleated screen apparatus and the screen member is folded when the screen is closed and spread when the screen is open.

4. The screen apparatus according to claim 1, wherein the elongated articulated bottom frame member includes a plurality of link members arranged in series and adjacent link members are pivotal relative to each other, wherein the link members are pivotally mounted to each other by pivot pins about transverse pivot axes and the link members may be contiguous with each other; and wherein the articulated bottom frame member defines a longitudinally extending open channel for receiving a lower end portion of the screen therein.

5. The screen apparatus according to claim 3, wherein the screen member includes a lower portion and the lower portion thereof is received in the open channel in use when the screen member is in the spread condition.

6. The screen apparatus according to claim 1, wherein the screen apparatus further includes a guide formation provided on a support surface above which the screen apparatus is installed, wherein the guide formation is a guide track, and the guide track guides displacement of the articulated bottom frame member across the support surface when the screen is moved between open and closed positions.

7. The screen apparatus according to claim 4, wherein the articulated bottom frame member defines transversely spaced apart downwardly projecting guide or retainer formations for cooperating with the guide track on the support surface; and wherein each link member includes spaced apart opposing link sidewalls and a link web extending transversely between the sidewalls intermediate upper and lower edges of the sidewalls, wherein the open channel of the bottom frame member is defined between upper portions of the link sidewalls and the link web, and the retainer or guide formations are formed by lower parts of the link sidewalls.

8. The screen apparatus according to claim 1, wherein the displaceable side frame member also includes retainer formations towards a bottom end thereof for cooperating with the guide track provided on the support surface.

9. The screen apparatus according to claim 1, wherein the articulated bottom frame member includes a plurality of longitudinally spaced apart transversely projecting guide formations, and wherein each link member includes two guide formations, one on each link sidewall, that project transversely outwards away from the associated link sidewall; wherein each of the fixed side frame member and the overhead frame member define guide paths within which the transversely projecting guide formations are received, and with which the transverse projecting guide formations cooperate to guide displacement of the articulated bottom frame member along the side travel path and the overhead travel path; wherein each link member includes two guide formations, one on each link sidewall, that project transversely outwards away from the associated link sidewall; and wherein each of the fixed side frame members and the overhead frame member define guide slots or guide channels for cooperating with the guide formations on the link members.

10. The screen apparatus according to claim 9, wherein the fixed side frame member include a top portion where it joins with the overhead frame member, and wherein the fixed side frame member includes a bottom portion where it joins with the guide rail guiding movement of the bottom frame member and moveable side frame member across the support surface; wherein the bottom portion of the fixed side frame member includes a lower turn guide formation for causing the link members to turn through 90 degrees to enable them to travel vertically up through the side travel path fixed side frame member; wherein the lower turn guide formation comprises opposing sidewalls that define opposing curved guide slots, each of which curves through an angle of 90 degrees or undergoes a change in direction of 90 degrees for guiding displacement of the link members through 90 degrees when displaced around the 90 degree corner formed between the horizontal track rail and the vertically extending side travel path; wherein the upper portion of the fixed side frame member includes an upper turn guide formation for causing the link members to turn through 90 degrees to enable them to transition from the vertically extending side travel path to the horizontally extending overhead travel path so that at least some of the link members can pass into the overhead travel path and be received within the overhead frame member; wherein the upper turn guide formation includes opposed curved guide slots that curve through an angle of 90 degrees for guiding displacement of the link members though 90 degrees from the vertically extending side travel path and the horizontally extending overhead travel path; and wherein the overhead frame member defines another longitudinally extending overhead hanger travel path that faces downwardly, that is below the overhead travel path for the link members, and wherein the overhead frame member includes longitudinally extending opposing hanger rails that project inwardly towards each other from side walls of the overhead frame member whereby to form and define said overhead hanger path.

11. The screen apparatus according to claim 1, wherein the screen apparatus further includes a plurality of hanger members that are mounted on the overhead frame member within the overhead hanger path and which can travel along the overhead hanger path by sliding displacement along the hanger travel path; and wherein each hanger member includes an attachment formation for attaching to the screen and/or an uppermost tension chord of a tension chord arrangement for supporting the screen, wherein the attachment formation includes a snaring formation having a free end for snaring the screen or tension chord, and wherein the snaring formation is a hook like formation.

12. The screen apparatus according to claim 1, wherein the bottom frame member includes a bottom attachment formation path wherein the bottom attachment formation path includes bottom side channels on either side of the bottom frame member and wherein the path is defined in the sides of the links making up the bottom channel frame member.

13. The screen apparatus according to claim 1, wherein the screen apparatus further includes a plurality of bottom attachment formations that are mounted on the articulated bottom frame member and can slide along the bottom attachment formation path, wherein the attachment formations are received within the channels on either side of the links making up the bottom frame member; wherein each bottom attachment formation is mounted on both of the sidewalls of a link making up the bottom frame member and is capable of sliding within the bottom side channels; and wherein each attachment formation is adapted for attachment to a lowermost tension cord of a tension cord arrangement and/or the screen member, for resisting blow-out or push-out of the screen member from the upper channel of the articulated bottom frame member, wherein each screen attachment formation includes a snaring formation having a free end for snaring the screen or tension chord and wherein the snaring formation is a hook like formation.

14. The screen apparatus according to claim 1, wherein the screen apparatus including the screen member is manually displaced between spread and folded conditions by manual movement of the moveable side member towards and away from the fixed side member.

15. The screen apparatus according to claim 1, wherein the screen apparatus includes a pull chord arrangement for drawing or pulling the articulated bottom frame member into and along the side travel path and the overhead travel path when the displaceable side frame member is displaced towards the fixed side frame member, and also for pulling the bottom frame member out of the overhead and bottom frame members when the displaceable side frame member is moved away from the fixed side frame member; and wherein the pull chord arrangement includes two chords, each chord extending between an end of the articulated bottom frame member and an upper end of the displaceable side frame member, wherein the pull cords are routed and arranged so that one pull chord pulls the articulated bottom frame member towards the side travel path and overhead travel path when the side frame member is displaced towards the fixed side frame member, and the other pull chord displaces the articulated bottom frame member away from the side travel path and overhead travel path when the displaceable side frame member is displaced away from the fixed side frame member.

16. The screen apparatus according to claim 1, wherein the screen apparatus further includes a tension chord or cord arrangement for supporting the screen, wherein the tension chord arrangement includes a plurality of chords that are attached towards the opposing end of the overhead frame member and are routed horizontally towards an upper end of the displaceable side frame member, vertically downwards into the displaceable side frame member, and horizontally out off the displaceable side frame member towards the fixed side frame member to which their other ends are attached; and wherein the tension cords are slidably laced through the mesh screen, wherein the tension chords extend downwards into the displaceable side frame member and exit the displaceable side frame member at longitudinally spaced intervals more-or-less parallel to each other so that the screen is supported at said spaced intervals.

* * * * *